US009314679B2

(12) United States Patent
Engel

(10) Patent No.: US 9,314,679 B2
(45) Date of Patent: Apr. 19, 2016

(54) MODULAR GOLF BAG AND METHOD OF MAKING SAME

(71) Applicant: TAYLOR MADE GOLF COMPANY, INC., Carlsbad, CA (US)

(72) Inventor: Christopher Engel, Encinitas, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 113 days.

(21) Appl. No.: 14/073,588

(22) Filed: Nov. 6, 2013

(65) Prior Publication Data

US 2015/0122678 A1 May 7, 2015

(51) Int. Cl.
*A63B 55/00* (2015.01)

(52) U.S. Cl.
CPC ..... *A63B 55/00* (2013.01); *Y10T 29/49963* (2015.01)

(58) Field of Classification Search
CPC ..... A63J 55/00; A63B 55/00; A63B 55/40
USPC ..... 206/315.6, 315.8, 315.3
See application file for complete search history.

(56) References Cited

U.S. PATENT DOCUMENTS 2,751,955 A 6/1956 Nahon
3,901,299 A 8/1975 Picco
4,091,977 A 5/1978 Luttbeg
4,249,586 A * 2/1981 Setani ..... A63B 55/005 206/315.4
4,709,814 A 12/1987 Antonious
4,753,344 A 6/1988 Antonious
4,796,752 A 1/1989 Reimers
5,048,777 A 9/1991 Quellais
5,096,148 A 3/1992 Quellais et al.
5,147,089 A 9/1992 Anderson
5,178,273 A 1/1993 Igarashi
5,209,350 A 5/1993 Maeng
5,339,951 A 8/1994 Chen
5,356,003 A 10/1994 Gretz et al.
5,361,899 A 11/1994 Reimers
5,407,155 A 4/1995 Chung
5,445,267 A 8/1995 Biafore, Jr.
5,458,240 A 10/1995 Rich et al.
5,482,160 A 1/1996 Perrin
5,507,384 A 4/1996 Maeng
5,518,113 A 5/1996 Boone
5,528,813 A 6/1996 Biafore, Jr.
5,573,112 A 11/1996 Kim
5,638,954 A 6/1997 Hsien
5,769,219 A 6/1998 Shimel
5,772,024 A * 6/1998 Lueders ..... A63B 55/00 206/315.3
5,785,173 A 7/1998 Kim
5,806,675 A 9/1998 Kim (Continued)

FOREIGN PATENT DOCUMENTS

CN ZL-2010-2-0026935.4 11/2010

*Primary Examiner* — Sue A Weaver
(74) *Attorney, Agent, or Firm* — Duane Morris LLP

(57) ABSTRACT

A modular golf bag assembly and method of assembly are disclosed. The assembly includes: a golf bag body; a top collar attached to a top portion of the golf bag body; a bottom collar attached to a bottom portion of the golf bag body; a plurality of stays contained within the golf bag body and securely attached at respective ends to the top and bottom collars. In further embodiments, the assembly also includes a top divider configured for ratcheted attachment to the top collar and a base member configured to screwed onto the bottom collar.

5 Claims, 13 Drawing Sheets

(56) References Cited

U.S. PATENT DOCUMENTS 5,845,773 A 12/1998 Kim
5,857,567 A 1/1999 Cheng
5,911,322 A 6/1999 Lombardo et al.
5,918,737 A 7/1999 Kwon
5,941,383 A 8/1999 Cheng
5,996,789 A 12/1999 Suggs et al.
6,004,229 A * 12/1999 Fazekas ..... A63B 57/00 473/406
6,010,101 A 1/2000 Stein et al.
6,036,009 A 3/2000 Kim
6,062,383 A 5/2000 Han
6,076,245 A 6/2000 Sutter
6,115,872 A 9/2000 Welsh
6,220,433 B1 4/2001 Kang
6,227,503 B1 5/2001 Shiao Chen
6,386,362 B1 5/2002 Cheng
6,390,295 B2 5/2002 Rhee
6,422,955 B1 * 7/2002 Lopez ..... A42B 1/24 224/918
6,427,835 B1 * 8/2002 Chang ..... A63B 55/00 206/315.2
6,435,345 B1 8/2002 Wang
6,510,944 B2 1/2003 Chang
6,568,527 B1 5/2003 Te-Pin
6,598,744 B2 7/2003 Chen
6,634,497 B1 10/2003 Chang
6,712,206 B2 3/2004 Chen
6,817,469 B2 11/2004 Chang
6,935,496 B2 8/2005 Chang et al.
6,938,762 B2 9/2005 Cheng
7,152,524 B2 12/2006 Davidson
D564,871 S * 3/2008 Pitcher ..... D8/395
D565,944 S * 4/2008 Pitcher ..... D8/395
8,032,423 B2 10/2011 Aubery et al.
8,141,705 B2 3/2012 Aubery et al.
2002/0096444 A1 * 7/2002 Chang ..... A63B 55/00 206/315.6
2003/0056866 A1 3/2003 Sheppard, Jr.
2003/0089629 A1 5/2003 Tan
2004/0026280 A1 2/2004 Herold
2004/0211688 A1 10/2004 Doss
2004/0226839 A1 11/2004 Su
2005/0016881 A1 * 1/2005 Whitten et al. ..... A63B 55/00 206/315.3
2005/0040059 A1 2/2005 Herold
2005/0061692 A1 3/2005 Chen
2005/0072695 A1 4/2005 Shaanan
2006/0006082 A1 1/2006 Fair et al.
2006/0006083 A1 1/2006 Fair et al.
2006/0006084 A1 1/2006 Burgess et al.
2006/0108243 A1 5/2006 Tan
2006/0108244 A1 5/2006 Tan
2006/0163093 A1 7/2006 Kronenberger
2006/0201832 A1 9/2006 Tan
2007/0138040 A1 6/2007 Chan
2008/0251399 A1 10/2008 Rhee
2009/0057180 A1 3/2009 Smeltzer
2009/0261004 A1 10/2009 Davidson
2009/0308768 A1 12/2009 Quartarone
2010/0320105 A1 12/2010 Aubery et al.
2011/0162985 A1 * 7/2011 Shiao ..... A63B 55/00 206/315.8
2013/0042886 A1 * 2/2013 Carey Stachowski ..... 132/278
2014/0034528 A1 * 2/2014 Anderson ..... A63B 55/00 206/315.6
2015/0076019 A1 * 3/2015 Cheng ..... A63B 55/00 206/315.6

* cited by examiner

MODULAR GOLF BAG AND METHOD OF MAKING SAME

FIELD OF THE INVENTION

The invention relates generally to golf bags, and more particularly to golf bags made from modular components and methods for their assembly.

BACKGROUND OF THE INVENTION

Golf bags are standard and necessary equipment in the game of golf. Golf bags typically have a tubular construction with a closed bottom and an open top for receiving a plurality of golf clubs. Conventional bags and their methods of assembly, however, suffer from several disadvantages.

FIGS. 1A and 1B illustrate perspective views of modular components of an exemplary conventional golf bag assembly 100. The golf bag assembly 100 includes a golf bag body 102 (e.g., outer skin or body of the golf bag), a bottom collar 104, a base member 106, a top collar 108, a top divider 110, and a plurality of support rods 112 (a.k.a., "stays"). The top divider 110 typically provides a plurality of divided openings, each configured to receive one or more golf clubs. The golf bag body 102 comprises an elongated body having an approximately cylindrical or circular cross-section, and is typically made from reinforced nylon, leather, vinyl, and/or other suitable materials.

As shown in FIGS. 1A and 1B, the golf bag body 102 includes a bottom portion 103 configured to be coupled to the bottom collar 104 and base member 106 subassembly. The golf bag body 102 also includes a top portion 105 configured to be coupled to the top collar 108 and top divider 110 subassembly. The bottom collar 104 is fixedly attached (e.g., glued, sewn, riveted, etc.) to an internal surface of the bottom portion 103 of the golf bag body 102. Similarly, the top collar 108 is fixedly attached (e.g., glued, sewn, riveted, etc.) to an internal surface of the top portion 105 of the golf bag body 102. Subsequently, the top divider 110 engages with the top collar 108 while the base member 106 engages with the bottom collar 104. The top divider 110 and top collar 108 subassembly connects to the base member 106 and bottom collar 104 subassembly via the plurality of stays 112, which support the golf bag body 102.

Due to cheaper labor and manufacturing costs, modular components of a golf bag assembly are often manufactured and/or assembled outside of the United States ("U.S.") and thereafter shipped to the U.S. to be distributed and sold in the U.S. market. For example, each of the conventional components discussed above may be manufactured in China. Additionally, the modular components may be assembled with one another in China to create subassemblies for the golf bag, or a completely finished golf bag assembly, which are thereafter shipped to the U.S.

Shipping a completely finished golf bag assembly to the U.S., however, can be costly because the completed golf bag presents a relatively large volume for shipment, which increase shipping costs. Therefore, modular components, or subassemblies thereof, are often shipped separately to the U.S., where they are assembled into a complete golf bag. During shipment, however, the golf bag body 102 can undergo shrinkage and deformation due to changes in temperature and/or humidity during a long transit and/or storage period. Upon arrival in the U.S., shrinkage of the golf bag body 102 can make it difficult to assemble the remaining modular components of the golf bag with the golf bag body 102. For example, it is sometimes necessary to adjust the length of one or more stays 112 to accommodate a change in size of the golf bag body 102. Needless to say, making such adjustments significantly increases the labor, time and costs associated with assembling the golf bag. Additionally, the quality of the resulting golf bag can be compromised. Thus, there is a need for a modular golf bag and method of assembly that will provide a reduction in volume of components and/or subassemblies for shipment, while avoiding the problem of shrinkage and/or deformation of the golf bag bodies.

Additionally, in conventional golf bag assemblies, the top divider 110 is typically attached to the top collar 108 by means of mechanical coupling mechanisms that require precise manufacturing tolerances such that the dimensions of the top divider 110 must match very closely with corresponding dimensions of the collar 108. If these dimensions are slightly inaccurate, after the top divider 110 is attached to the collar 108, the top divider 110 can sometimes be easily separated from the top collar 108 when a user presses or pulls the divider/collar subassembly in certain directions. Even when the dimensions are matched accurately, conventional attachment mechanisms used to attach the top divider 110 to the top collar 108 still do not adequately prevent separation from occurring during use of the golf bag. This separation compromises the integrity of the golf bag and also results in a perception of inferior quality by consumers. Thus, there is a need for a modular golf bag and assembly method that will allow for greater manufacturing tolerances between the top divider 110 and top collar 108 as well as reducing the possibility of separation after the top divider 110 and top collar 108 are attached to one another.

Furthermore, in conventional golf bag assemblies, during attachment of the base member 106 to the bottom collar 104, since the base member 106 is closed, it is difficult to see and precisely align the base member 106 with the bottom collar 104 during attachment when conventional snap-fit or interlocking attachment mechanisms are used. If the base member 106 is misaligned with the bottom collar 104 during the attachment process, a worker must typically disengage the base member 106 from the bottom collar 104, which takes considerable time and effort since the conventional snap-fit or interlocking attachment mechanisms are designed to provide a fixed attachment once they are engaged. Additionally, during the dis-engagement process, the attachment mechanisms may become damaged, which compromises the structural integrity of the golf bag. Thus, there is a need for a modular golf bag and assembly method that will allow for easier alignment between the base member 106 and bottom collar 104 during the attachment process while providing a secure, fixed engagement between the base member 106 and bottom collar 104.

For golf bags having a kick-stand assembly and a kick-plate at the bottom of the golf bag for actuating the kick-stand legs, it has been found that assembly of conventional kick-plates in conventional golf bags can sometime be difficult due to the high tension required to engage an actuator rod with a semi-open slot on the kick plate. If this tension is reduced, then the engagement is not as secure as it would otherwise be, which results in occasional disengagement of the actuator rod from the kick-plate during actual use. This results in great annoyance to the user of the golf bag as well as a consumer perception of inferior quality. Thus, there is a need for an improved kick-plate and method of easily assembling the kick-plate with the base member and actuator rod of a kick-stand assembly.

The foregoing is a discussion of exemplary drawbacks and needs presented by conventional golf bags and their assembly process, and should not be construed as a limiting or exhaustive list of drawbacks and needs.

SUMMARY OF THE INVENTION

Various embodiments of the invention, as described herein, address some or all of the above-described exemplary needs, as well as other needs, associated with prior art modular golf bag assemblies. Generally, the various embodiments of the invention provide a modular golf bag and method of assembly that reduces costs associated with the manufacture, shipping and/or assembly of the modular components of the golf bag, while providing improved attachment mechanisms that increase the quality and integrity of the golf bag.

In one embodiment, the invention provides a modular golf bag assembly that includes: a golf bag body; a top collar attached to a top portion of the golf bag body, the top collar comprising a first plurality of stay receiver members; a bottom collar attached to a bottom portion of the golf bag body, the bottom collar comprising a second plurality of stay receiver members; and a plurality of stays located inside the golf bag body, each stay having a first end coupled to a respective one of the first plurality of stay receiver members, and a second end coupled to a respective one of the second plurality of stay receiver members, wherein both the top and bottom collars are deformable and the plurality of stays prevent substantial longitudinal shrinkage of the golf bag body.

In another embodiment, the invention provides a modular golf bag assembly that includes: a golf bag body; a top collar attached to a top portion of the golf bag body; a bottom collar attached to a bottom portion of the golf bag body; a top divider configured to be attached to the top collar, wherein top divider comprises a first plurality of ratcheting mechanisms, and the top collar comprises a second plurality of ratcheting mechanisms that engage corresponding ones of the first plurality of ratcheting mechanisms to provide a secure attachment between the top divider and the top collar; and a base member configured to be attached to the bottom collar, wherein the base member comprises a first plurality of screw holes and the bottom collar comprises a second plurality of screw holes configured to be aligned with respective ones of the first plurality of screw holes, and wherein the base member is attached to the bottom collar with a plurality of screws inserted through respective pairs of the first and second plurality of screw holes.

In a further embodiment, the invention provides a method of assembling a modular golf bag, the method including: receiving a first subassembly comprising: a golf bag body; a top collar attached to a top portion of the golf bag body, the top collar comprising a first plurality of stay receiver members; a bottom collar attached to a bottom portion of the golf bag body, the bottom collar comprising a second plurality of stay receiver members; and a plurality of stays located inside the golf bag body, each stay having a first end coupled to a respective one of the first plurality of stay receiver members, and a second end coupled to a respective one of the second plurality of stay receiver members, wherein both the top and bottom collars are deformable and the plurality of stays prevent substantial longitudinal shrinkage of the golf bag body; attaching a top divider to the top collar; and attaching a base member to the bottom collar.

In yet another embodiment, the invention provides a method of assembling a modular golf bag, the method including: receiving a first subassembly comprising: a golf bag body; a top collar attached to a top portion of the golf bag body; and a bottom collar attached to a bottom portion of the golf bag body; attaching a top divider to the top collar by engaging a first plurality of ratcheting mechanisms located on the top divider with respective ones of a second plurality of ratcheting mechanisms located on the top collar; and attaching a base member to the bottom color by aligning a first plurality of screw holes on the base member with respective ones of a second plurality screw holes on the bottom collar, and thereafter securing the base member to the bottom collar with a plurality of screws inserted into respective pairs of the first and second plurality of screw holes.

BRIEF DESCRIPTION OF THE DRAWINGS

Exemplary embodiments of the invention are described in detail with reference to the following figures. The drawings are provided for purposes of facilitating the reader's understanding of various exemplary features of the invention, and should not be considered limiting of the breadth, scope, or applicability of the invention. It should be noted that for clarity and ease of illustration these drawings are not necessarily drawn to scale.

DETAILED DESCRIPTION OF EXEMPLARY EMBODIMENTS OF THE INVENTION

Various exemplary embodiments of the invention are described in detail below with reference to the figures, wherein like elements are referenced with like numerals throughout.

Figure 2A:
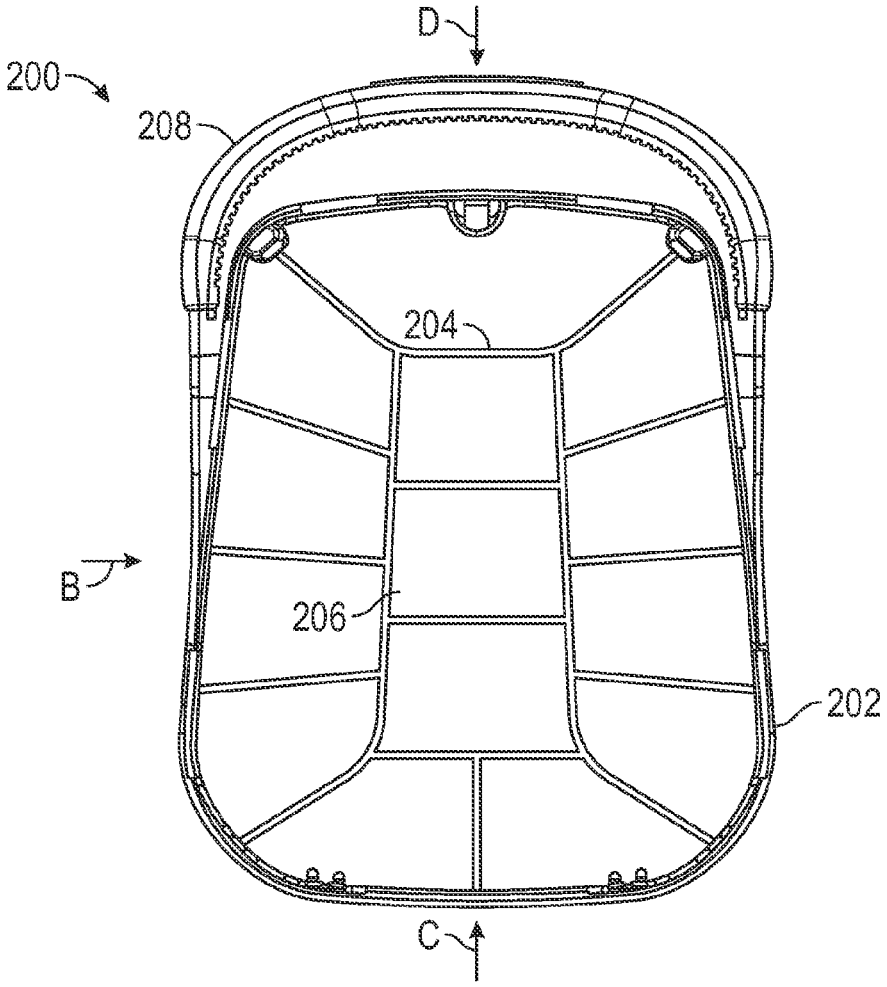
FIGS. 2A-2D illustrates perspective views of a top divider of a modular golf bag assembly, in accordance with one embodiment of the invention.

FIG. 2A illustrates a perspective top view of a top divider 200 in accordance with one embodiment of the invention. The top divider 200 includes a substantially cylindrical perimeter wall 202 that defines the outer shape of the opening of a golf bag body (not shown) in which it is installed. A plurality of interior walls 204 coupled to the perimeter wall 202 define interior sub-spaces 206, each sub-space 206 configured to provide an opening for one or more golf clubs (not shown) to pass through and be received within the golf bag body. In the embodiment shown in FIG. 2A, the top divider 200 provides fourteen sub-spaces 206, each configured to receive one golf club. In alternative embodiments, the interior walls 204 may be configured to provide any number of desired sub-spaces 206 having any one of various desired shapes and sizes. The top divider 200 also includes an optional handle 208 attached to the perimeter wall 202 to facilitate grabbing and/or lifting of the golf bag by a user.

Figure 2B:
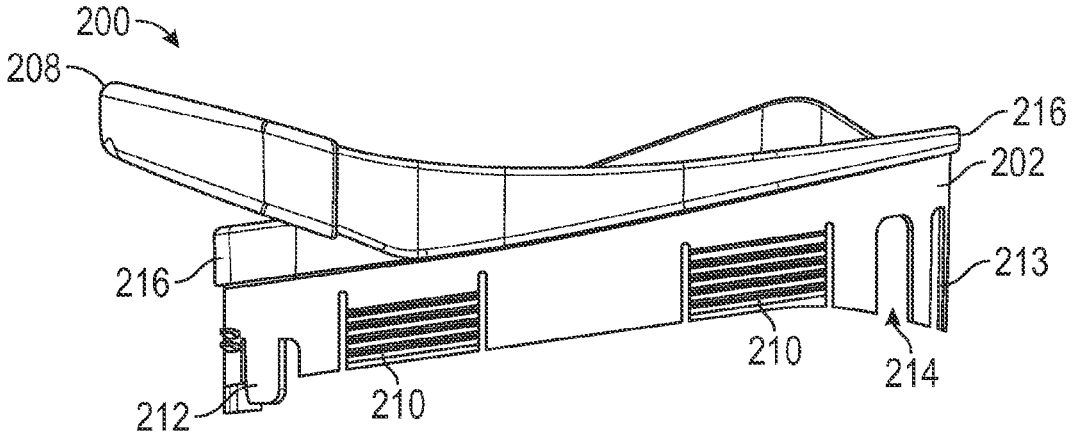

FIG. 2B illustrates a perspective side view of the top divider 200 viewed in the direction of arrow B in FIG. 2A. The perimeter wall 202 includes a plurality of ratcheting mechanisms 210 formed at a plurality of predetermined spaced-apart locations on an exterior surface of the perimeter wall 202. In one embodiment, the ratcheting mechanisms 210 each include a plurality of horizontal ratchet teeth configured to engage corresponding slots, ridges or ratchet teeth located on a top collar 300 (FIGS. 3A-3E) to provide a ratchet-type attachment mechanism between the top divider 200 and top collar 300, as described in further detail below. The perimeter wall 202 further includes a plurality of front and rear finger members 212 and 213, respectively, extending downwardly to engage corresponding front and rear loop members 306 and 307, respectively, located on the top collar 300, in order to prevent rotation of the top divider 200 with respect to the top collar 300 after they are attached to one another. The perimeter wall 202 further includes a plurality of cut-outs 214 located to receive correspondingly located stay receiver members 308 of the top collar 300 (FIG. 3A), as discussed in further detail below. As shown in FIG. 2B, the top divider 200 also includes a top lip portion 216 that is configured to engage a top perimeter edge of the top collar 300 and limit the travel of the top collar 300 in an upward direction with respect to the top divider 200.

Figure 2C:
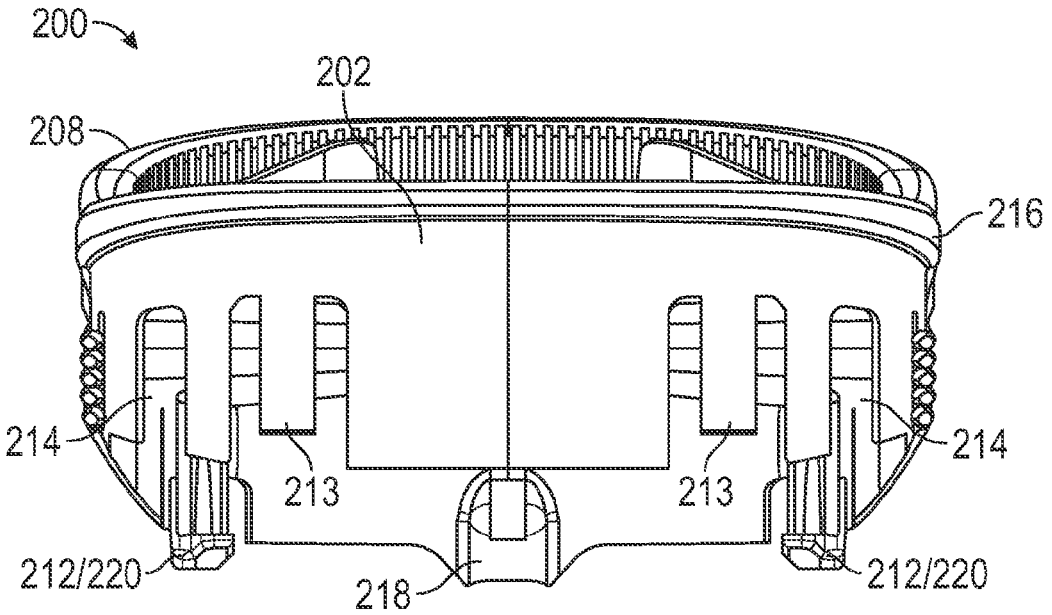

FIG. 2C illustrates a perspective side view of the top divider 200 viewed in the direction of arrow C in FIG. 2A. FIG. 2C provides a view of the anti-rotation fingers 212/213 and the cut-outs 214 mentioned above. Additionally, the top lip portion 216 is shown to extend around the top edge of the perimeter wall 202. Located on an interior surface of the perimeter wall 202 at the side nearest the handle 208 is a cylindrical receptacle 218 for receiving therein a correspondingly located cylindrical stay receiver member 308 of the top collar 300 (FIG. 3A), when the top divider 200 is attached to the top collar 300 as discussed in further detail below. As shown in FIG. 2C, in one embodiment, the two front finger members 212 extending downwardly from perimeter wall 202 on the side closest to the handle 208 each further include optional hook members 220 located at the ends of the fingers 212. As discussed in further detail below, each of these hook members 220 interlock with corresponding front loop member 306 to provide a more secure and fixed attachment between the top divider 200 and top collar 300, as discussed further below.

Figure 2D:
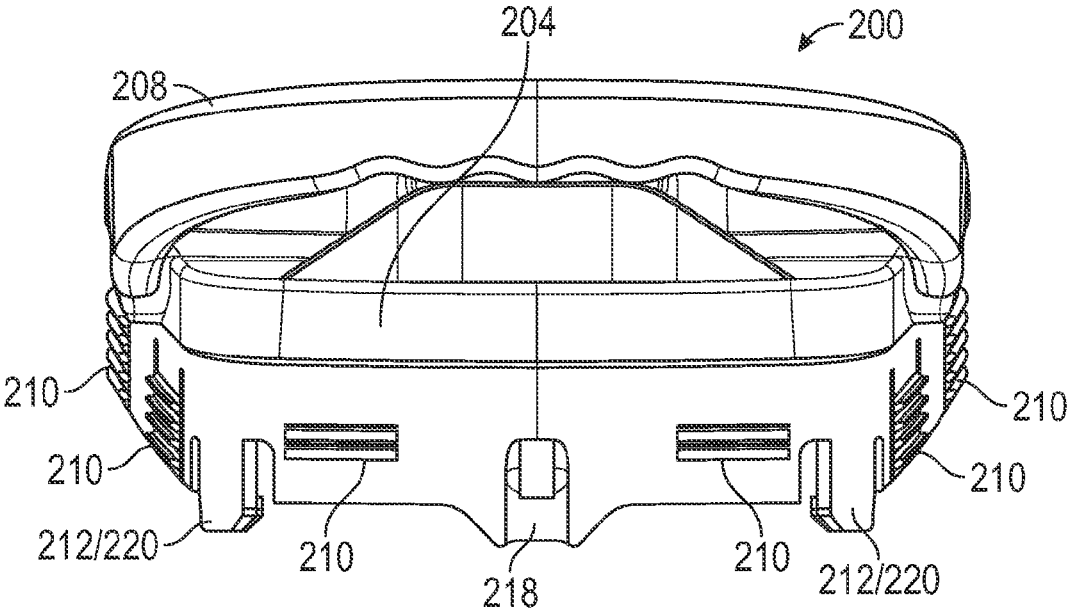

FIG. 2D illustrates a perspective side view of the top divider 200 viewed in the direction of arrow D in FIG. 2A, which is a view in the opposite direction of FIG. 2C discussed above. As shown in FIG. 2D, a plurality of ratcheting mechanisms 210 are formed at a plurality of spaced apart locations on the exterior side surface of the perimeter wall 202. In the embodiment shown, there are six ratcheting mechanisms 210, each having a plurality of horizontal ratchet ridges or teeth for engagement with a correspondingly located ratchet mechanism of the top collar 300, as described in further detail below. Rear views of the cylindrical receptacle 218 and the fingers 212 with optional hook members 220 are also shown.

Figure 3A:
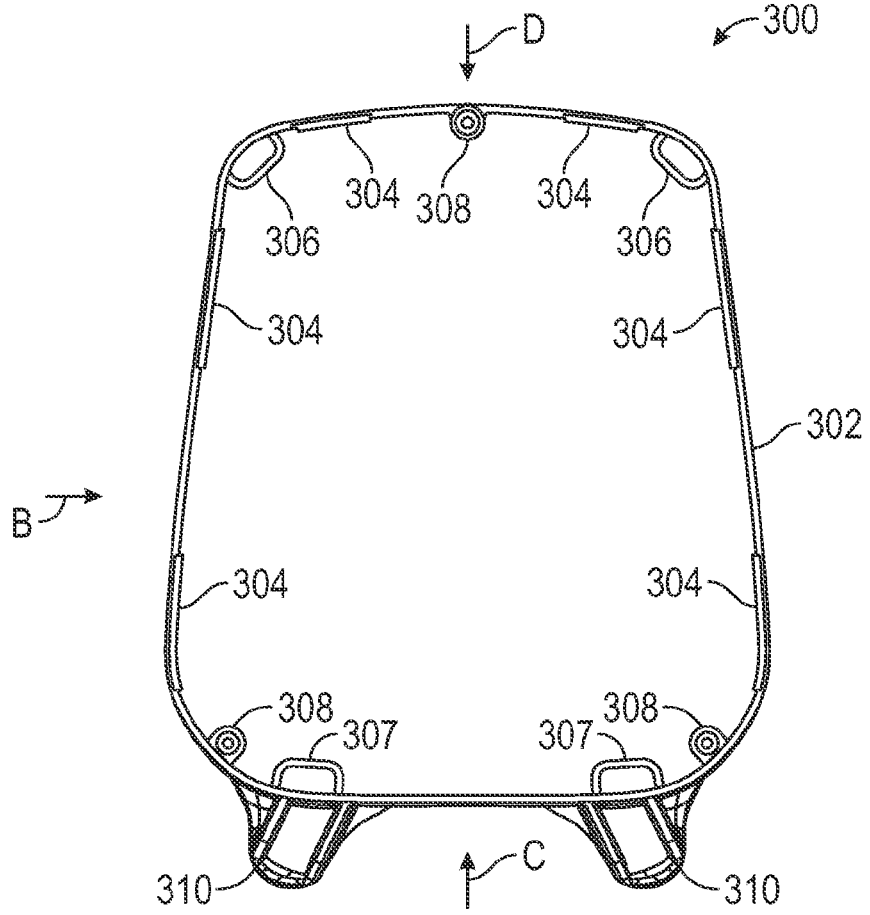
FIGS. 3A-3E illustrates perspective views of a top collar of a modular golf bag assembly, in accordance with one embodiment of the invention.

FIG. 3A illustrates a perspective top view of a top collar 300, in accordance with one embodiment of the invention. The top collar 300 includes a substantially cylindrical perimeter wall 302. A plurality of ratcheting mechanisms 304 are located at predetermined spaced-apart locations on an interior side surface of the perimeter wall 302. In one embodiment, each ratcheting mechanism 304 includes a plurality of horizontally oriented ridges or ratchet teeth to engage and interlock with correspondingly located ratcheting mechanisms 210 of the top divider 200, as described above. The top collar 300 also includes a plurality of loop portions 306 and 307 formed at predetermined spaced-apart locations on the interior side surface of the perimeter wall 302. The front loops 306 are configured to receive and interlock with corresponding front finger members 212 having optional hooks 220, as discussed above. The rear loops 307 are configured to receive and interlock with corresponding rear finger members 213 of the top divider 200, as described above. The engagement between the finger members 212 and 213 of the top divider 200 and the front and rear loops 306 and 307, respectively, of the top collar 300 prevent rotation and horizontal separation between the top divider 200 and the top collar 300 after they are attached to one another. The engagement between the ratchet mechanisms 210 of the top divider 200 with corresponding ratchet mechanisms 304 of the top collar 300 prevent vertical separation between the top divider 200 and top collar 300, as well as deterring horizontal separation. The optional hooks 220 on the front finger members 212, when engaged with corresponding loops 306 add further security against vertical slippage or movement between the top divider 200 and top collar 300 after they are attached to one another.

Figure 3B:
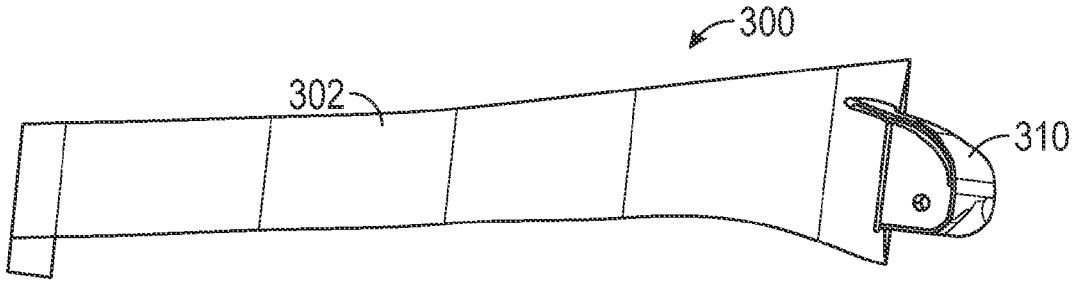

FIG. 3B illustrates a perspective side view of the top collar 300 when viewed from a direction indicated by arrow B as shown in FIG. 3A. As shown in FIGS. 3A and 3B, the top collar 300 further includes two hinge members 310 extending outwardly from a rear exterior surface of the perimeter wall 302. Each hinge member 310 is configured to receive a respective end of a kick-stand leg (not shown).

Figure 3C:
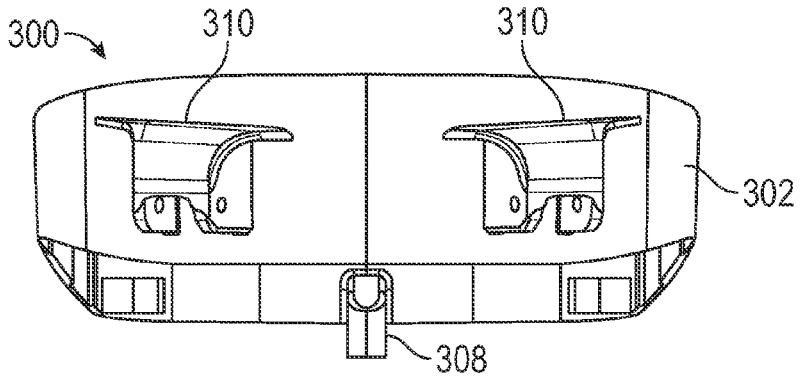

FIG. 3C illustrates a perspective rear view of the top collar 300 when viewed from a direction indicated by arrow C as shown in FIG. 3A. In this figure, the hinge members 310 and stay receiver member 308 extending outwardly from a front portion of the interior surface of the perimeter wall 302 are clearly shown.

Figure 3D:
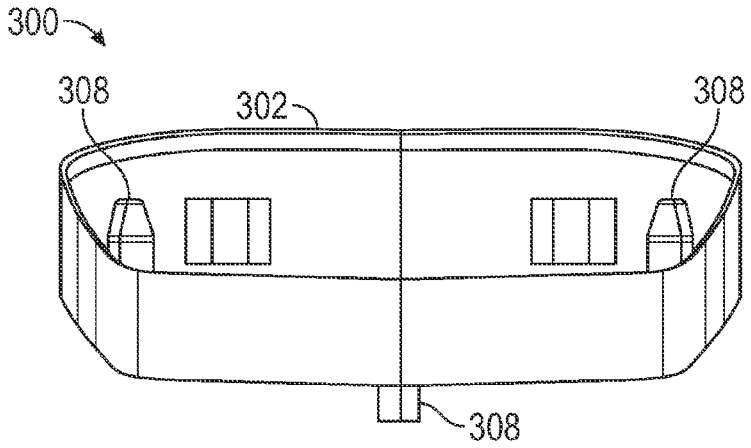

FIG. 3D illustrates a perspective front view of the top collar 300 when viewed from a direction indicated by arrow D as shown in FIG. 3A. This figure shows two stay receiver members 308 extending outwardly from the rear interior surface of the perimeter wall 302. A bottom portion of a third stay receiver member 308 is also shown extending downwardly from behind the front portion of the perimeter wall 302. Each of the three stay receiver members 308 are configured to receive and hold a respective end of a stay 112 (i.e., support rod) (See FIG. 1B), as described in further detail below.

Figure 3E:
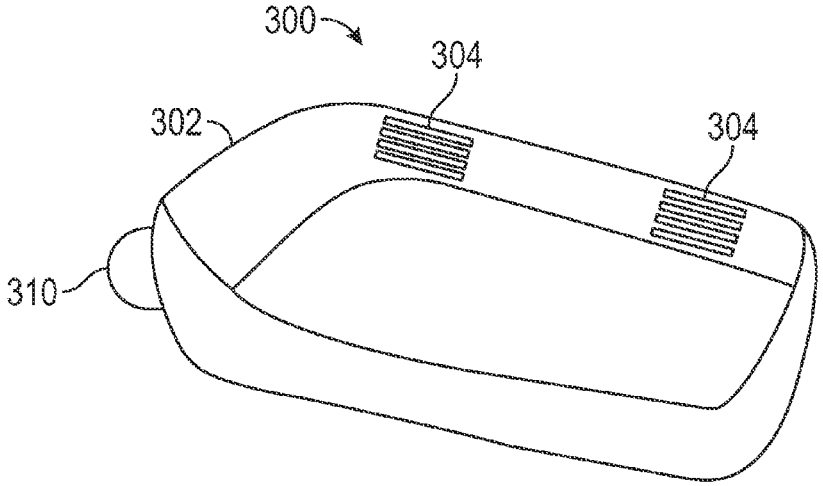

FIG. 3E illustrates a perspective view of the top collar 300. Located at predetermined spaced-apart locations on the interior surface of the perimeter wall 302 are a plurality of ratcheting mechanisms 304. In one embodiment, each ratcheting mechanism 304 includes a plurality of ratchet teeth configured to engage and interlock with correspondingly located ratcheting mechanisms on the top divider 200 when the top divider 200 and top collar 300 are attached together during the golf bag assembly process.

Figure 4A:
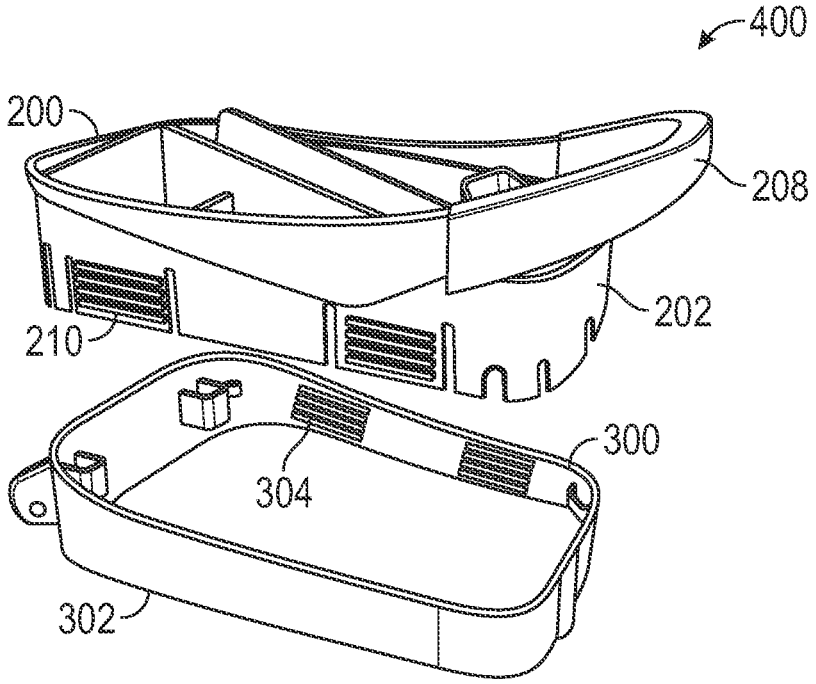
FIG. 4A illustrates a perspective view of a top divider aligned with a top collar prior to attachment, in accordance with one embodiment of the invention.

FIG. 4A illustrates a top divider and top collar subassembly 400 comprising the top divider 200 and the top collar 300, discussed above, prior to attachment. In one embodiment, as shown in FIG. 4A, a bottom portion of the perimeter wall 202 of the top divider 200 (i.e., that portion not including the top lip portion 216) is sized and shaped to tightly fit inside the perimeter wall 302 of the top collar 300 such that the exterior surface of the perimeter wall 202 is substantially flush with the interior surface of perimeter wall 302. As the top divider 200 is inserted into the top collar respective ratcheting mechanisms 210 and 304 engage each other in a step-wise fashion as the top divider 200 is pushed further and further inside the top collar 300.

The coupling of the ratcheting mechanism 210 and 304 becomes more and more secure as additional respective teeth of the ratcheting mechanisms engage each other. When the top divider 200 is fully inserted into the top collar 300, multiple rows of ratchet teeth are engaged with one another at multiple predetermined spaced-apart locations of the subassembly 400. This ratcheted coupling at multiple locations provides an extremely secure coupling between the top divider 200 and top collar 300 so that the possibility of vertical and horizontal separation between the top divider 200 and top collar 300 is minimized. Furthermore, the coupling between finger members 212 and 213 and corresponding loops 306 and 307, respectively, as described above, further prevents horizontal separation and rotation between the top divider 200 and top collar 300.

Figure 4B:
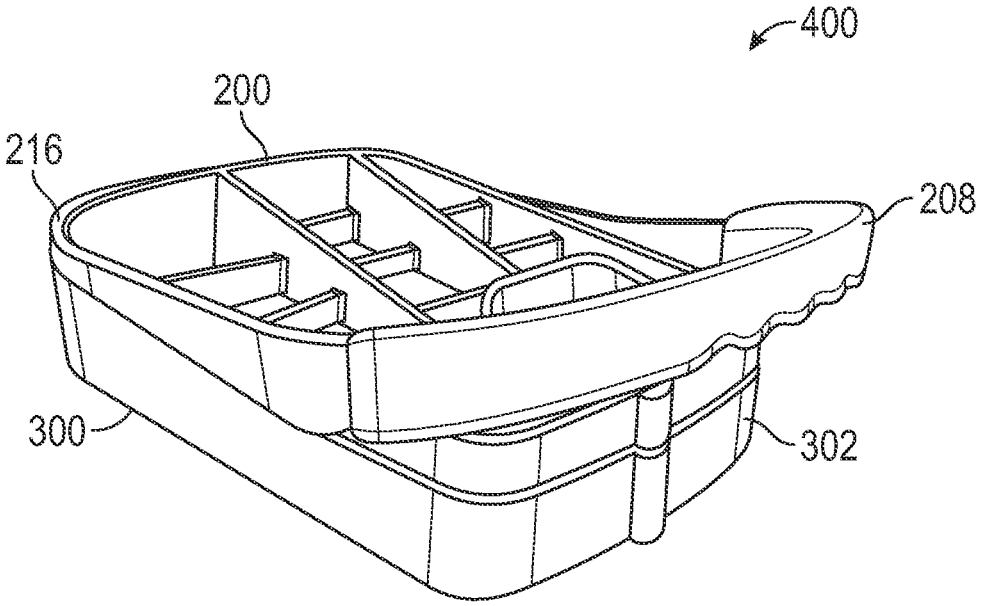
FIG. 4B illustrates a perspective view of a top divider attached to a top collar, in accordance with one embodiment of the invention.

FIG. 4B illustrates a perspective view of the top divider and collar subassembly 400 after the top divider 200 has been fully engaged with the top collar 300. As shown in FIG. 4B, the top divider 200 is pressed downwardly inside the top collar 300 until a bottom edge of the top lip portion 216 of the top divider 200 makes contact with a top edge of the perimeter wall 302 of the top collar 300. In this manner, a substantially flush engagement is achieved between the top divider 200 and top collar 300. Because the top divider 200 is open it is very easy to accurately align the top divider 200 with the top collar 300 so that all coupling structures discussed above are accurately aligned during the assembly process. This allows for a fast and efficient assembly process with minimal errors, and largely avoids disassembly of the subassembly 400 after it has been assembled. It has been found that incorporating the ratcheting mechanisms in the top divider and collar subassembly, as discussed above, significantly improves the time and labor required to assemble modular golf bags on a large scale, while providing secure attachment mechanisms that substantially eliminates or reduces the possibility of any separation between the top divider 200 and the top collar 300 during subsequent use of the resulting golf bag.

In one embodiment, each of the top divider 200 and top collar 300 are formed from an integrally molded synthetic material (e.g., plastic). The dimensions (e.g., wall thickness) of the top divider 200 and/or the material used to form the top divider 200 are selected such that the top divider 200 is relatively rigid when compared to the top collar 300. The dimensions and/or material of the top collar 300 are selected to allow the top collar 300 to be relatively flexible such that it can be deformed during transit. When assembled together, the combination of the top divider 200 and the top collar 300 provide a rigid, reinforced structure that is highly durable. Those of ordinary skill can readily determine the dimensions and/or material compositions of the top divider 200 and the top collar 300 to achieve desired rigidity and flexibility characteristics for each.

Figure 5:
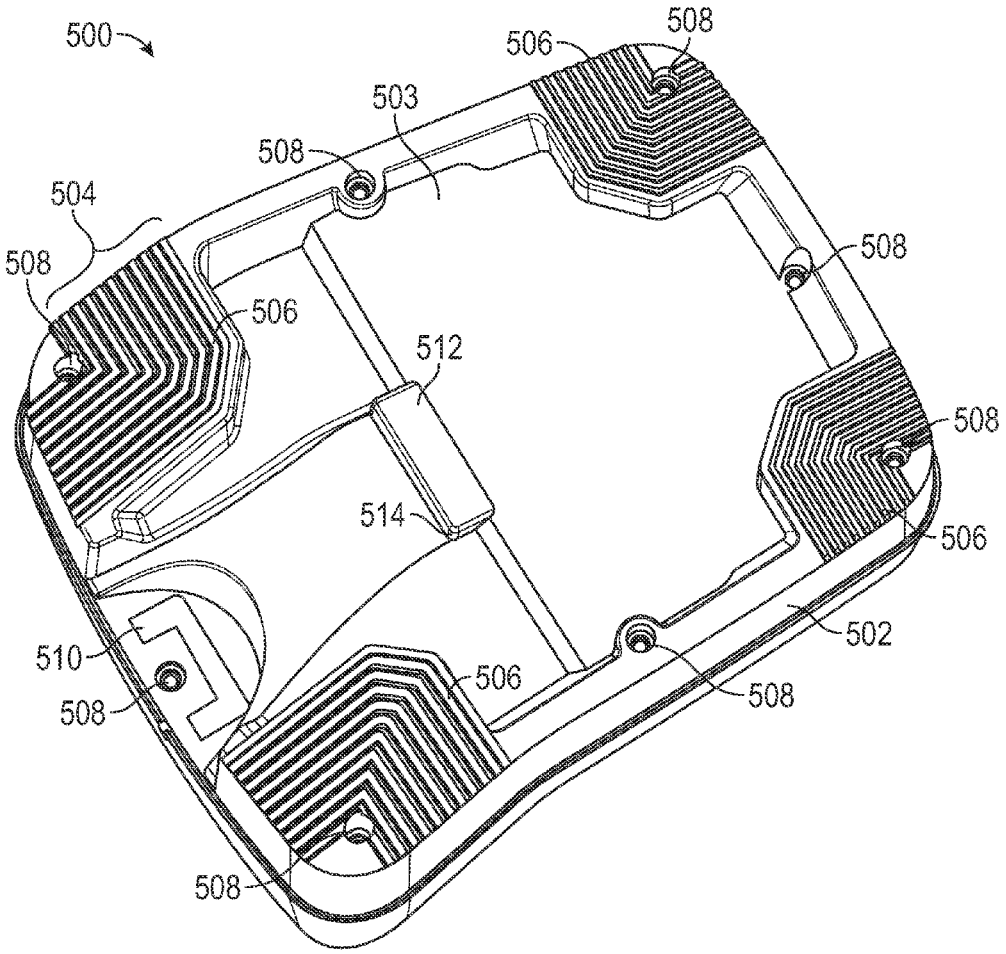
FIG. 5 illustrates a perspective bottom view of a base member of a modular golf bag, in accordance with one embodiment of the invention.

FIG. 5 illustrates a perspective bottom view of a base member 500, in accordance with one embodiment of the invention. The base member 500 includes a peripheral side wall 502 and a bottom wall 503 that closes the bottom of the golf bag (not shown). In one embodiment, the peripheral side wall 502 and bottom wall 503 may be integrally formed from a suitable synthetic material via an injection-molding process. The bottom wall 503 includes an inclined portion 504 that facilitates activation of a kick-plate 950 (FIGS. 10A-10F) when the golf bag is resting at an angle on kick-stand legs (not shown). Located at respective corners of the base member 500 are contoured grooves 506 for providing increased traction when they engage a ground surface. In one embodiment, the contoured grooves 506 are integrally molded into the surface of the bottom wall 503.

The base member 500 further includes a plurality of pre-drilled, recessed screw holes 508 for facilitating secure attachment of the base member 500 with a bottom collar 600 (FIG. 6), as described in further detail below. An actuating rod slot 510 is provided in the angled portion 504 of the bottom wall 503. The slot 510 allows a bottom portion of a kick-stand actuating rod (not shown) to pass through so that the bottom portion of the actuating rod can be secured to the kick-plate 950 (FIGS. 10A-10F), as discussed further below. A retaining wall 512 is also provided on the bottom surface of the bottom wall 503 and defines a groove or slot 514 configured to receive one end of the modular kick-plate 950, as discussed further below. It is understood that the inclined portion 504, the slot 510, retaining wall 512, slot 514 and kick plate 950 are only necessary for golf bags configured with kick-stand assemblies. In alternative embodiments, the modular golf bag of the invention may be a "cart bag" type, which are designed primarily to be placed on the back of a golf cart, and do not have kick-stand assemblies. In such embodiments, the inclined portion 504, the slot 510, retaining wall 512, slot 514 and kick plate 950 is omitted.

Figure 6A:
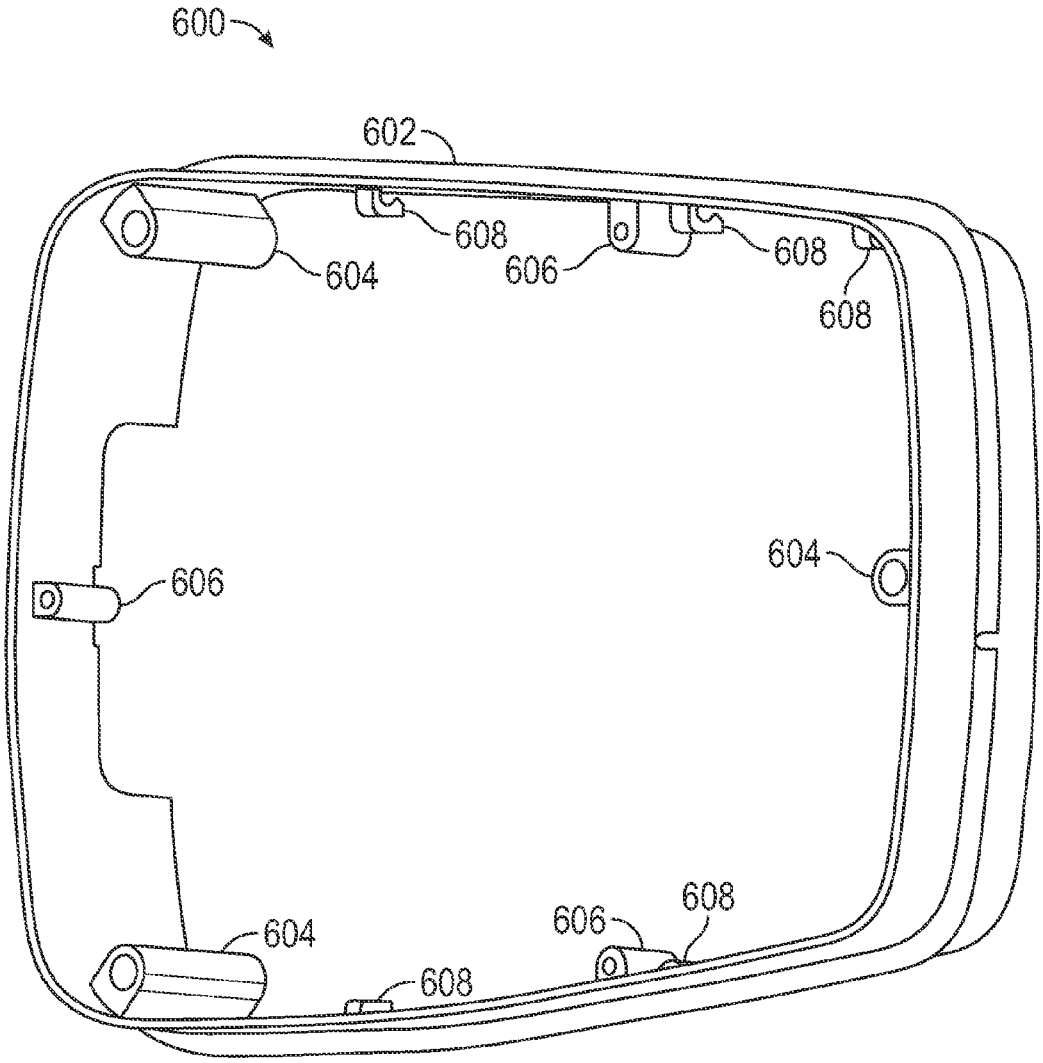
FIG. 6A illustrates a perspective view of a bottom collar of a modular golf bag, in accordance with one embodiment of the invention.

FIG. 6A illustrates a perspective view of a bottom collar 600, in accordance with one embodiment of the invention. The bottom collar 600 includes a substantially cylindrical perimeter wall 602. Extending outwardly from predetermined spaced-apart locations of an interior surface of the perimeter wall 602 are a plurality of stay receiver members 604, each having a cylindrical cavity for receiving an end of a respective stay (not shown) therein. A plurality of screw hole members 606 also extend outwardly from predetermined spaced-apart locations of the interior surface of the perimeter wall 602. The screw hole members 606 each provide a pre-formed screw hole for receiving and engaging a threaded screw therein. In one embodiment, each of the stay receiver members 604 also provide a pre-formed screw hole that is located on the opposite side of the cylindrical cavity for receiving an end of a stay. The plurality of screw hole members 606 and stay receiver members 604 are located to correspond to the locations of the pre-drilled, recessed screw holes 508 of the base member 500 such that they align with screw holes 508 during attachment of the base member 500 with the bottom collar 600.

Figure 6B:
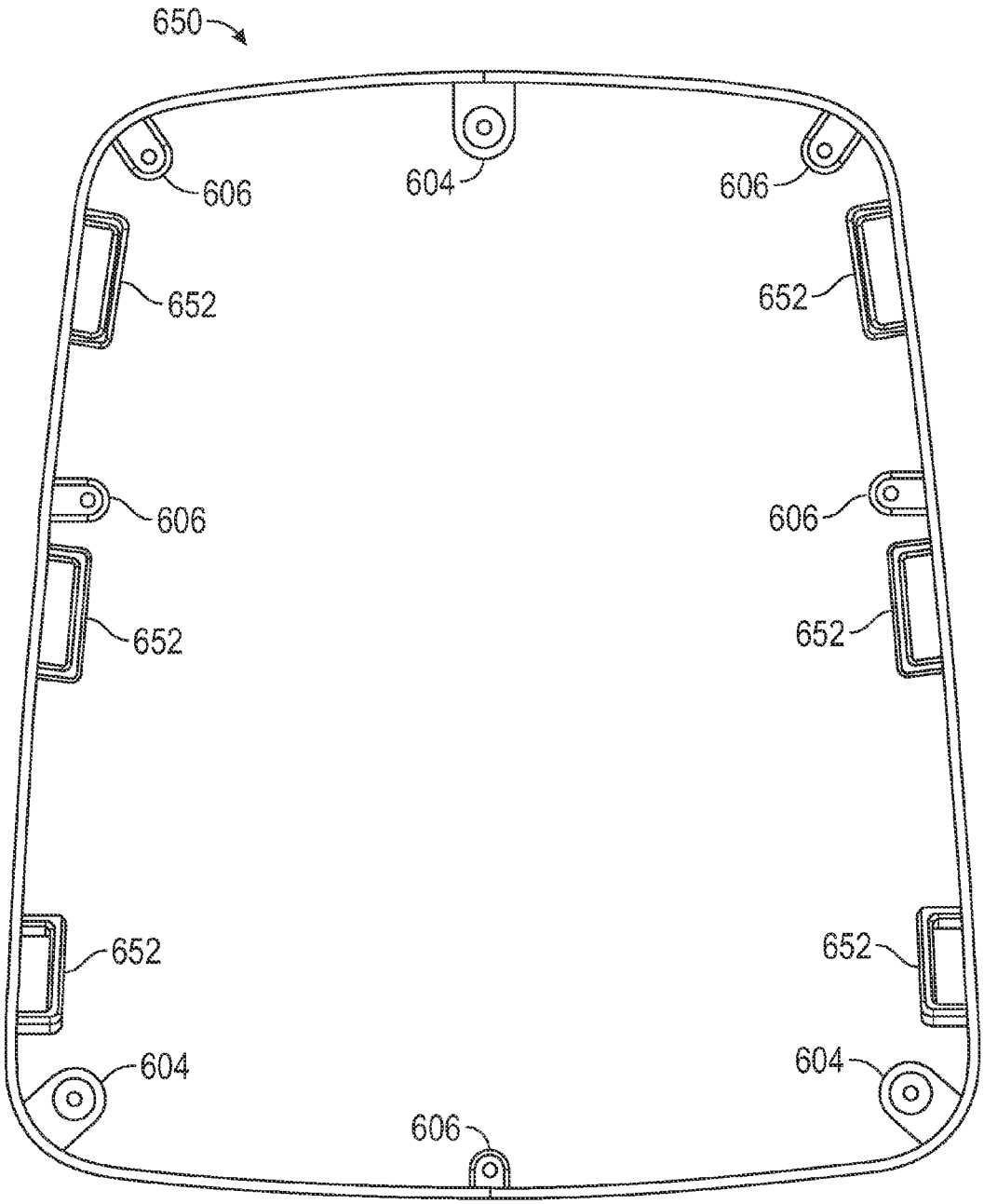
FIG. 6B illustrates a perspective top view of a bottom collar of a modular golf bag, in accordance with alternative embodiment of the invention.

The bottom collar 600 further includes a plurality of hook members 608 extending outwardly from predetermined spaced-apart locations of the interior surface of the perimeter wall 602, in accordance with one embodiment. As described in further detail below, the hook members 608 are configured to engage and hold corresponding loops or hook members 904, located at one end of a divider sleeve 902 (FIG. 9A), which provides an internal lining for one or more longitudinal compartments within the golf bag body FIG. 6B illustrates a top view of a bottom collar 650, in accordance with another embodiment of the invention. The bottom collar 650 is similar to the bottom collar 600 discussed above with respect to FIG. 6A, however, the bottom collar 650 includes a plurality of attachment loops 652 which replace the hooks 608 of the bottom collar 600. As discussed in further detail below, the attachment loops 652 are each configured to engage butterfly clips 906 attached to the divider sleeve 902 (FIG. 9A) to secure a bottom portion of the divider sleeve 902 to the bottom collar 650.

Figure 7:
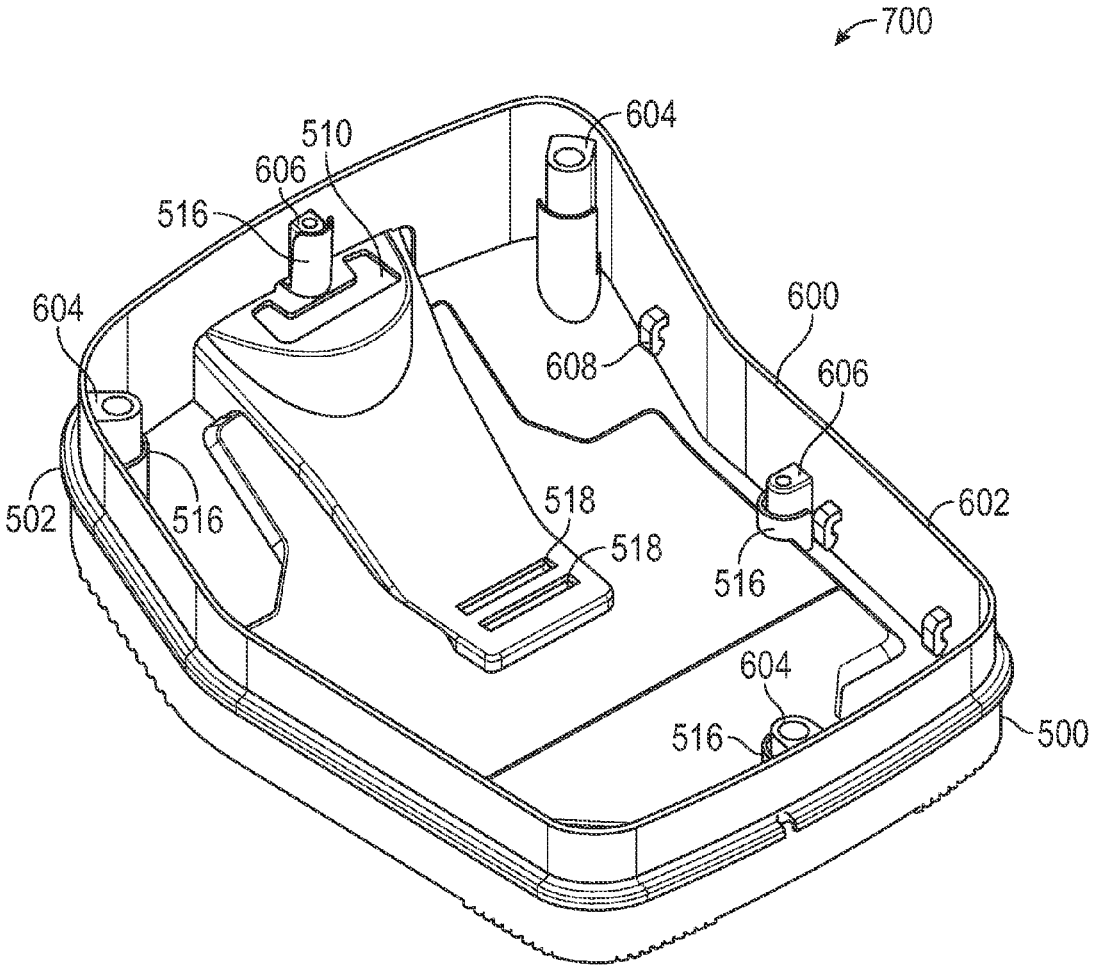
FIG. 7 illustrates a perspective view of a base member attached to a bottom collar, in accordance with one embodiment of the invention.

FIG. 7 illustrates a perspective view of a base member and bottom collar subassembly 700 comprising the base member 500 attached to the bottom collar 600. In one embodiment, as shown in FIG. 7, the bottom collar 600 is sized and shaped to be tightly fitted within the interior space of the base member 500. FIG. 7 further illustrates additional structural features of the base member 500, in accordance with one embodiment of the invention. A plurality of alignment cylinders 516 extend upwardly from an interior surface of the bottom wall 503 of the base member 500. The alignment cylinders 516 are sized and located to receive therein correspondingly located stay receiver members 604 and screw hole members 606 of the bottom collar 600. The alignment cylinders 516 facilitate and ensure proper alignment between the base member 500 and the bottom collar 600 before their fixed attachment with screws (not shown). The base member 500 further includes a plurality of grooves 518 formed on the bottom wall 503. As discussed in further detail below, the grooves 518 are configured to receive and hold corresponding "tongue" members 972 of a kick-plate 950 (FIGS. 10A-10F).

It has been found that ratcheting mechanisms similar to those discussed above with respect to attachment of the top divider 200 and top collar 300, are not well-suited for attaching the base member 500 and bottom collar 600. Because the base member 500 is closed at the bottom, it is difficult to see and judge proper alignment prior to performing a ratcheted engagement. If one side is improperly aligned or tilted during the engagement process, it is possible for the engagement to be skewed and not result in a perfectly flush engagement, in which case the components must be pulled apart, possibly resulting in damage to the ratchet teeth and thereafter compromising the integrity of the coupling. By utilizing screws, pre-drilled screw holes, and alignment mechanisms as discussed above, the base member 500 may be perfectly aligned with the bottom collar 600 before the screws are utilized to provide a fixed attachment. This eliminates or at least significantly reduces errors and consequent dis-assembly of the base and bottom collar subassembly 700 after it is assembled. Thus, the method of assembling the subassembly 700 using screws, pre-drilled screw holes and alignment mechanisms, as described above, provides an extremely reliable and durable attachment mechanism, while also providing significant savings in time and labor when assembling modular golf bags, especially on a large scale.

Figure 8:
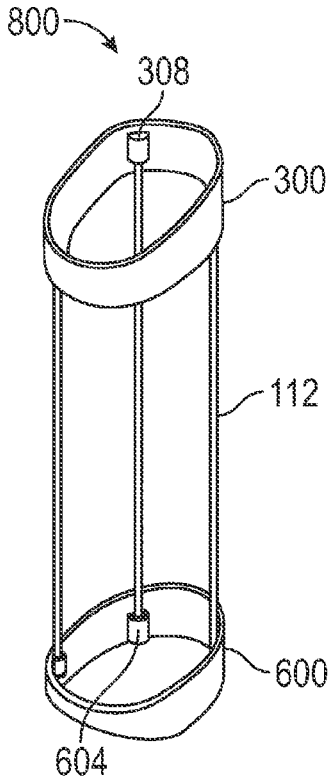
FIG. 8 illustrates a perspective view of a subassembly of a modular golf bag, in accordance with one embodiment of the invention.

FIG. 8 illustrates a perspective view of a subassembly 800, in accordance with a further embodiment of the invention. The subassembly 800 includes the top collar 300, bottom collar 600, a plurality of stays 112, and a golf bag body (not shown). FIG. 8 illustrates simplified renditions of the top and bottom collars 300 and 600, respectively. Each stay 112 has a top end received within and coupled to a respective stay receiver member 308 of the top collar 300 and a bottom end received within and coupled to a respective stay receiver member 604 of the bottom collar 600.

Figure 1A:
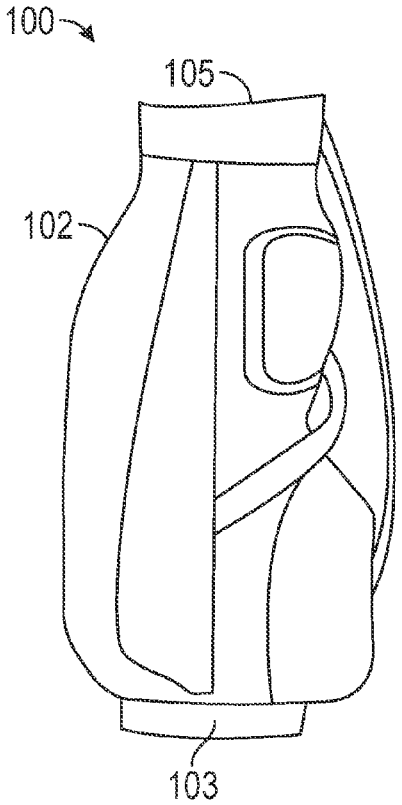
FIG. 1A (Prior Art)
FIGS. 1A and 1B illustrate modular components of a conventional golf bag assembly.
Figure 1B:
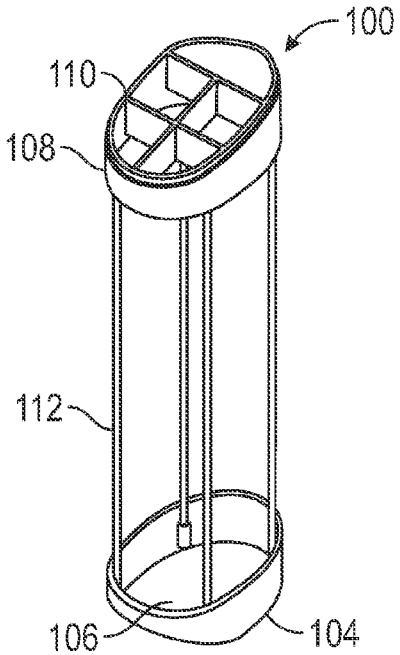
FIG. 1B (Prior Art)

For purposes illustrating the coupling of the top and bottom collars 300 and 600, with the stays 112, a golf bag body is not shown in FIG. 8, although the golf bag body constitutes a part of subassembly 800. The golf bag body may have similar features to the golf bag body 102 illustrated in FIG. 1A. In alternative embodiments, the golf bag body may be a "cart bag" type or, alternatively, a golf bag configured to incorporate a kick-stand assembly. Referring to FIGS. 1A and 8, in one embodiment, the top collar 300 is fixedly attached to an internal surface of an upper portion 105 of the golf bag body 102. Such fixed attachment can be accomplished by various known mechanisms such as riveting, gluing, stitching, Velcro, stapling, etc., or any combination of such known attachment mechanisms. Similarly, the bottom collar 600 is fixedly attached to an outer surface of a bottom portion 103 of the golf bag body 102 using any known attachment mechanism such as riveting, gluing, stitching, Velcro, stapling, etc., or combination of attachment mechanisms.

The subassembly 800 provides particular advantages if it is first assembled at a distant location for subsequent shipment to another location for completion of assembly. In one embodiment, the material and/or dimensions of the top collar 300 and bottom collar 600 are such that they are flexible and easily deformable. Therefore, during shipment the subassembly 800 may be pressed and flattened to a certain degree to decrease the volume of the subassembly 800 for shipment. In this manner, the number of subassemblies 800 that can be held within a predetermined shipment container is significantly increased. The stays 112, which remain coupled to the top and bottom collars 300 and 600 during shipment, help to prevent shrinkage of the golf bag body due to changes in temperature and/or humidity during a long transit. Thus, the subassembly 800 decreases shipment costs by providing a decreased volume of the article being shipped, while also preventing shrinkage and/or deformation of the golf bag body during long transits.

After the subassembly 800 arrives at its intended destination (e.g., U.S.) for completion of assembly, a top divider 200 may be attached to the top collar 300 of the subassembly 800 in the manner described above. Additionally, a base member 500 may be attached to the bottom collar 600 of the subassembly 800 in the manner described above.

Figure 9A:
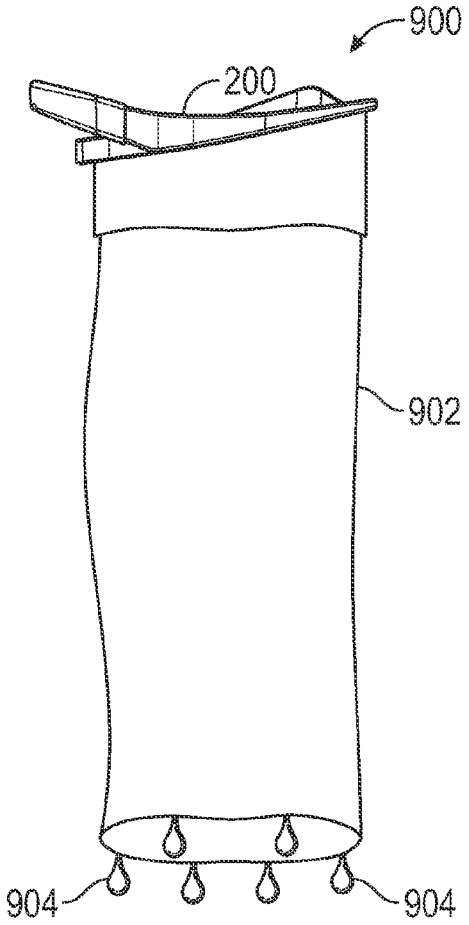
FIG. 9A illustrates a perspective view of another subassembly of a modular golf bag, in accordance with one embodiment of the invention.

FIG. 9A illustrates a top divider and divider sleeve subassembly 900, in accordance with a further embodiment of the invention. The subassembly 900 includes the top divider 200 as previously discussed above with respect to FIGS. 2A-2D. The subassembly 900 further includes a divider sleeve 902 made from a suitable material (e.g., reinforced nylon) having an upper portion attached to the top divider 200. Various methods and mechanisms for attaching the divider sleeve 902 to the top divider 200 may be employed, such as riveting, gluing, stapling, Velcro, etc., or any combination of these mechanisms. As known to those of ordinary skill in the art, the divider sleeve 902 provides an internal lining for one or more longitudinal compartments within the golf bag body. The divider sleeve can be made from any suitable material (e.g., reinforced nylon) to serve this purpose. A plurality of attachment loops 904 are fixedly attached to the bottom of the divider sleeve 902. The attachment loops 904 are configured to engage corresponding hooks 608 located on the interior wall of the bottom collar 600, as described above with respect to FIG. 6A.

Figure 9B:
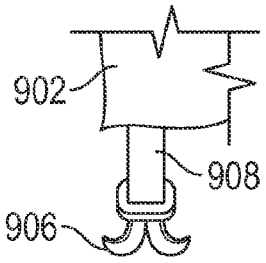
FIG. 9B illustrates a perspective view of an alternative attachment mechanism for attaching a divider sheet to a bottom collar of a modular golf bag, in accordance with one embodiment of the invention.

As an alternative embodiment to the attachment loops 904, FIG. 9B illustrates one of a plurality of butterfly hooks 906 attached to a bottom of the divider sleeve 902 by means of a strap 908. The butterfly hooks 906 are configured to engage and interlock with attachment loops 652 of bottom collar 650 of FIG. 6B.

Subassembly 900 can be easily and quickly assembled with the subassembly 800 of FIG. 8, which includes a golf bag body that is not shown for purposes of illustrating the internal skeletal structure of the subassembly 800. The bottom of the divider sleeve 902, with attachment loops 904 or butterfly clips 906, are first inserted through the opening provided by the top collar 300 of the subassembly 800. The top divider 200 is then attached to the top collar 300 in the manner discussed above. The bottom of the divider sleeve 902, with attachment loops 904 or butterfly clips 906, are then pulled toward the bottom collar 600, where the attachment loops 904 or butterfly clips 906 are securely fastened to corresponding hooks 608 or attachment loops 652 of the bottom collar 600 or 650, as discussed above. A base member 500 may then be securely attached to the bottom collar 600 or 650 as described above.

If the golf bag is configured to have kick-stand assembly, a two-piece modular kick plate 950, as illustrated in FIGS. 10A-10F, may be utilized in accordance with a further embodiment of the invention. Kick-stand assemblies for golf bags are generally well-known and need not be described in detail herein. However, conventional kick plates are difficult to install and sometimes can be disengaged from an actuator rod of the kick-stand assembly, which impairs the function of the kick-stand assembly and leads to a perception of inferior quality by consumers.

Figure 10A:
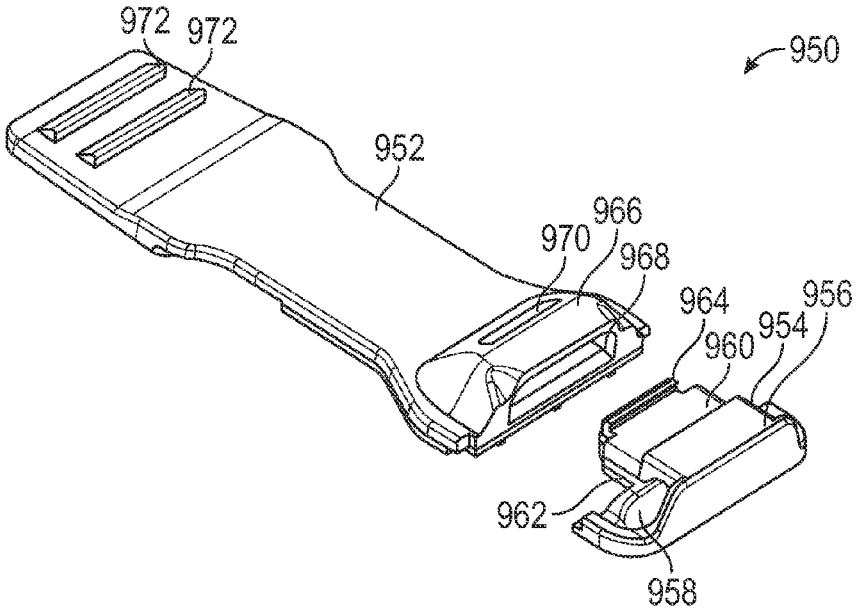
FIGS. 10A-10F illustrate perspective views of a two-piece modular kick-plate, in accordance with one embodiment of the invention.

FIG. 10A illustrates an exploded view of a two-piece modular kick plate 950, in accordance with one embodiment of the invention. The kick plate 950 includes a main body portion 952 and an end portion 954. The end portion 954 has hinge portion 956 which includes an internal groove 958 for receiving an actuator rod (not shown) therein. The actuator rod passes through the base member 500 through slot 510 (FIG. 5) on the base member 500 to be coupled to the kick plate 950. The end portion 954 further includes a top lip portion 960 and a bottom lip portion 962 which define a space between them where the actuator rod can squeeze through to be received within the groove 958. The top lip portion 960 includes a tongue portion 964 extending upwardly at its tip.

The main body portion 952 has a raised portion 966 that defines a slot 968 for receiving the top and bottom lip portions 960 and 962, respectively, of the end portion 954. After the actuator rod has been inserted into the groove 958 as described above, the top and bottom lip portions 960 and 962 are inserted into the slot 968. The tongue portion 964 engages a groove 970 located at a rear portion of the slot 968 to provide a secure "tongue and groove" attachment between the main body portion 952 and the end portion 954. The main body portion 952 further includes additional tongue portions 972 extending upwardly from a top surface of the main body portion 952 at a distal end opposite the end where the end portion 954 engages the main body portion 952. The tongue portions 972 are configured to engage and interlock with grooves 518 of base member 500 (FIG. 5), thereby attaching one end of the kick plate 950 to the base member 500, while the other end is engaged and interlocked with the actuator rod.

Figure 10B:
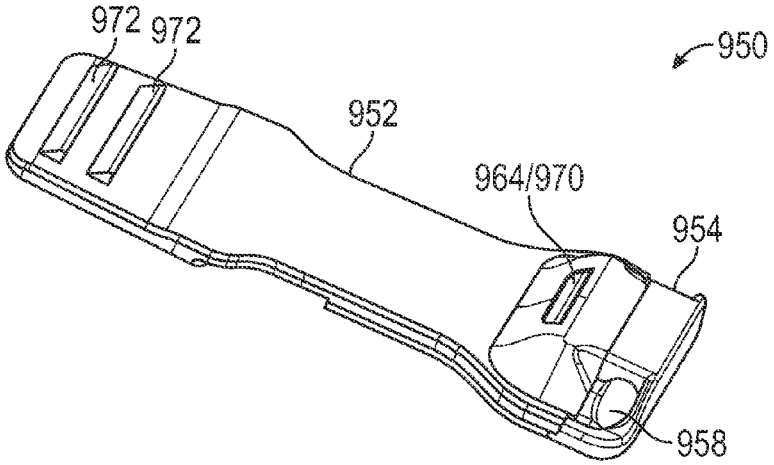
Figure 10C:
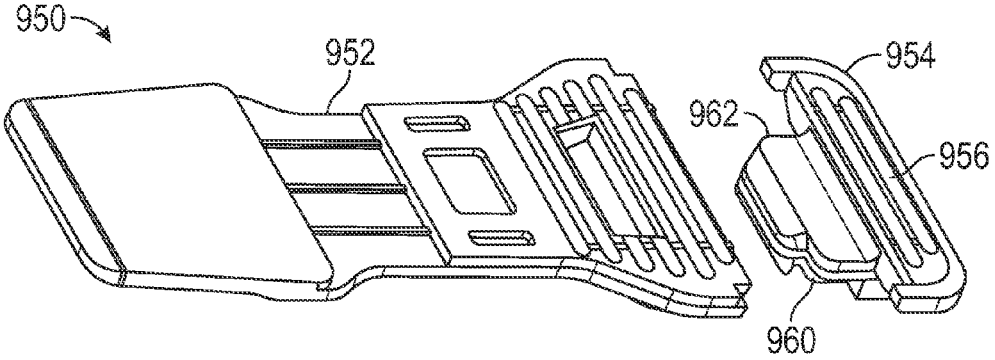
Figure 10D:
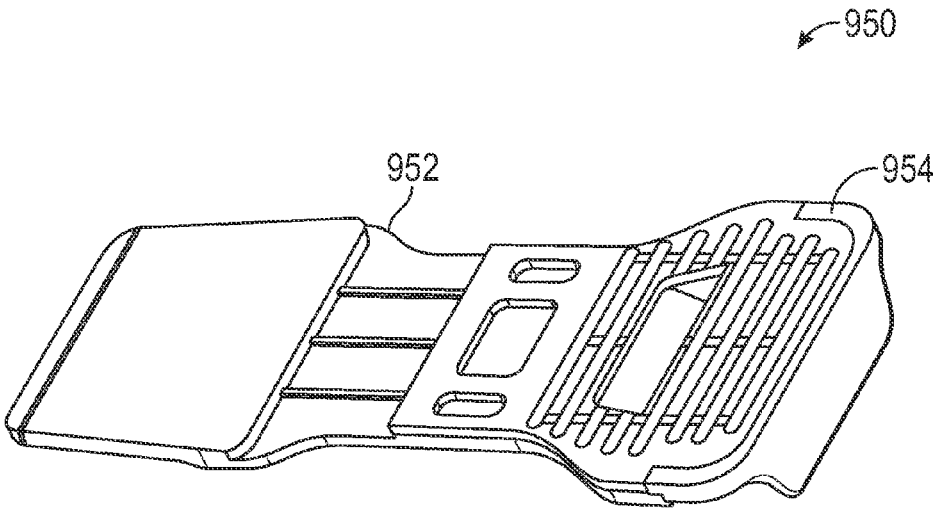

FIG. 10B illustrates a perspective view of the kick plate 950 after the main body portion 952 is securely interlocked with the end portion 954, as described above. FIG. 10C illustrates a perspective view of the bottom of the kick plate 950 prior to attachment of the main body portion 952 with the end portion 954, as discussed above. FIG. 10D illustrates a perspective view of the bottom of kick plate 950 after attachment of the main body portion 952 with the end portion 954, as discussed above.

Figure 10E:
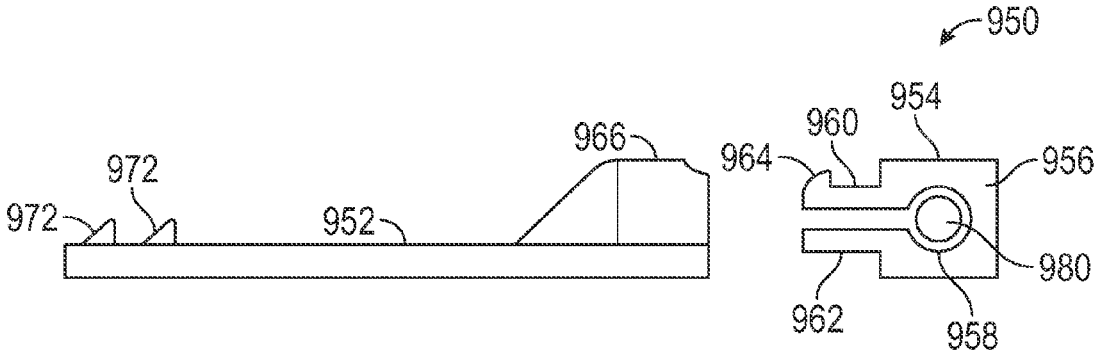

FIG. 10E illustrates a cross-sectional side view of the kick plate 950 prior to attachment of the main body portion 952 with the end portion 954, as discussed above. A cross-section of an actuator rod 980 is also shown in the groove 958. The actuator rod is easily inserted between the top and bottom lip portions 960 and 962, respectively, until it comes to rest in the form-fitting groove 958. The main body portion 952 is easily attached to the bottom of the base member by inserting its distal end into the slot 514 (FIG. 5) whereupon the tongue portions 972 will engage grooves 518 (FIG. 7) to provide a secure "tongue and groove" attachment between the main body portion 952 and the base member 500. Thereafter, the top and bottom lip portions 960 and 962 are inserted into the slot 968 of the main body portion 960 wherein the tongue portion 964 engages the groove 970 to provide a secure "tongue and groove" attachment between the main body portion 952 and the end portion 954.

Figure 10F:
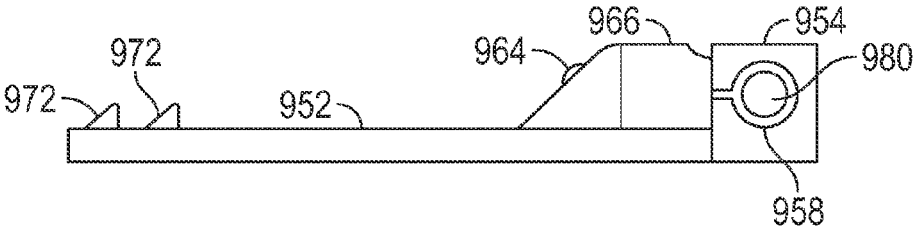

FIG. 10F illustrates a cross-sectional side view of the kick plate 950 after attachment of the main body portion 952 with the end portion 954, as discussed above, with an actuator rod secured within the groove 958. As can be readily appreciated, the two-piece modular kick plate 950 provides a fast and easy method of assembly with the base member 500 and actuator rod 980, while providing a more secure coupling between the kick plate 956 and the actuator rod 980.

The foregoing disclosures describes exemplary modular components and subassemblies, and corresponding methods of their assembly, in accordance with exemplary embodiments of the invention. As can readily be appreciated from the present disclosure, the above-described modular components, subassemblies and their methods of assembly provide highly reliable modular components and subassemblies of a modular golf bag system, while reducing significant time and costs associated with the manufacture, shipping and/or assembly process.

While various exemplary embodiments of the invention have been described above, it should be understood that they have been presented by way of example only, and not by way of limitation. Likewise, the various diagrams may depict exemplary structural features to aid in understanding some of the features, functions and advantages that can be provided by the invention. The invention is not restricted to the illustrated exemplary structures or configurations, however, but can be implemented using a variety of alternative structures and configurations as would be understood by those of ordinary skill in the art. Additionally, although the disclosure is described above in terms of various exemplary embodiments and implementations, it should be understood that the various features and functionality described in one or more of the individual embodiments are not limited in their applicability to the particular embodiment in which they are described. Rather, they can be applied, alone or in some combination, to one or more of the other embodiments of the invention. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; adjectives such as "conventional," "traditional," "normal," "standard," "known", and terms of similar meaning, should not be construed as limiting the item described to a given time period, or to an item available as of a given time. But instead these terms should be read to encompass conventional, traditional, normal, or standard technologies that may be available, known now, or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to", or other like phrases in some instances shall not be read to mean that the narrower case is intended or required in instances where such broadening phrases may be absent.

What is claimed is:

1. A modular golf bag assembly, comprising:

a golf bag body;

a top collar attached to a top portion of the golf bag body, the top collar comprising a first plurality of stay receiver members;

a bottom collar attached to a bottom portion of the golf bag body, the bottom collar comprising a second plurality of stay receiver members; and a plurality of stays located inside the golf bag body, each stay having a first end coupled to a respective one of the first plurality of stay receiver members, and a second end coupled to a respective one of the second plurality of stay receiver members, wherein the plurality of stays prevent substantial longitudinal shrinkage of the golf bag body;

wherein the top collar is configured receive therein a top divider to provide a rigid reinforced structure, the top collar being relatively flexible compared to the top divider such that the top collar can be deformed during transit prior to receiving therein the top divider; and wherein the bottom collar is configured to be received within a base member and has a similar flexibility as the top collar and can also be deformed during transit prior to being received within the base member.

2. The modular golf bag assembly of claim 1, further comprising the top divider, wherein the top divider comprises a first plurality of ratcheting mechanisms, and the top collar comprises a second plurality of ratcheting mechanisms that engage corresponding ones of the first plurality of ratcheting mechanisms to provide a secure attachment between the top divider and the top collar.

3. The modular golf bag assembly of claim 2 further comprising the base member, wherein the base member comprises a first plurality of screw holes and the bottom collar comprises a second plurality of screw holes configured to be aligned with respective ones of the first plurality of screws, and wherein the base member is attached to the bottom collar with a plurality of screw inserted through respective pairs of the first and second plurality of screw holes.

4. The modular golf bag assembly of claim 3 further comprising a two-piece modular kick-plate coupled to a bottom surface of the base member and to an actuating rod, wherein the two-piece modular kick plate comprises a first piece configured to be secured to the bottom surface of the base member and a second piece configured to receive and hold a portion of the actuating rod, wherein the second piece is configured to be securely attached to the first piece after receiving the portion of the actuating rod therein.

5. The modular golf bag assembly of claim 2 further comprising a divider sleeve coupled to the top divider, the divider sleeve comprising a first plurality of attachment mechanisms coupled to a bottom portion of the divider sleeve, wherein the bottom collar comprises a second plurality of attachment mechanisms each configured to securely engage a respective one of the first plurality of attachment mechanisms, thereby holding the bottom portion of the divider sleeve near the bottom collar, wherein the divider sleeve provides an internal lining for one or more longitudinal compartments within the golf bag body.

* * * * *